United States Patent [19]

Golicz

[11] Patent Number: 4,925,362

[45] Date of Patent: May 15, 1990

[54] FEEDING MECHANISM

[75] Inventor: Roman M. Golicz, Clinton, Conn.

[73] Assignee: GBR Systems Corporation, Chester, Conn.

[21] Appl. No.: 238,414

[22] Filed: Aug. 31, 1988

Related U.S. Application Data

[62] Division of Ser. No. 878,642, Jun. 26, 1986, Pat. No. 4,799,663.

[51] Int. Cl.[5] ..... B65H 29/12

[52] U.S. Cl. ..... 414/790.7; 271/157; 271/189; 271/198; 271/207; 271/220

[58] Field of Search ..... 271/151, 157, 189, 198, 271/207, 224, 212, 220; 414/789, 790.7

[56] References Cited

U.S. PATENT DOCUMENTS

| | | | |
|---|---|---|---|
| 3,871,539 | 3/1975 | Nikkel | 271/212 X |
| 3,998,451 | 12/1976 | McInerny | 271/212 |
| 4,501,418 | 2/1985 | Ariga | 271/189 X |
| 4,569,622 | 2/1986 | Buck | 414/789 |
| 4,640,506 | 2/1987 | Luperti | 414/790.7 X |
| 4,700,941 | 10/1987 | Shill | 271/151 |
| 4,721,229 | 1/1988 | Dempf | 271/189 X |

*Primary Examiner*—Richard A. Schacher

*Attorney, Agent, or Firm*—Stoll, Previto & Hoffman

[57] ABSTRACT

A feeding mechanism for stacking and moving sheets of paper and the like in which sheets are moved to a stacking area where they are held stationary and accumulate in a stack. The stack is released and moved away from the stacking area after a predetermined number of sheets have accumulated in said stack. The moving mechanism includes upper and lower transport belts transversely offset from each other which are in different vertically adjacent planes to cause the belts to grasp and move the sheets. The stacking area is located between a sheet recording mechanism to record the number of sheets passing thereby and a stop mechanism to prevent forward movement of the stack. The sheet recording mechanism comprises a deflecting unit and the stop mechanism comprises a rotatable stop wheel.

3 Claims, 2 Drawing Sheets

FEEDING MECHANISM

This application is a division of pending U.S. Application Ser. No. 878,642 filed June 26, 1986, now U.S. Pat. No. 4,799,663.

BACKGROUND OF THE INVENTION

The present invention relates to an improved feeding mechanism and more particularly to a feeding mechanism adapted to sequentially feed a number of single sheets of paper onto a stacking area where they are accumulated in a stack which, upon receipt of a signal, is released to subsequent processes.

Some existing feed mechanism require constant operator intervention, attention and training. In addition, such feed mechanisms require adjustment to accommodate for variations in paper size, thickness, texture and configuration. Furthermore, such feeders do not make reliable provision for over-stacking or under-stacking, nor do they have means for accumulation of fed pages into an orderly and precisely superimposed and justified stack. Moreover, some of these mechanisms cannot reliably release the stack without loss of justification.

BRIEF DESCRIPTION OF THE INVENTION

The present invention overcomes these drawbacks and has for one of its objects the provision of an improved feeding mechanism which requires minimum operation, training, orientation and instruction.

Another object of the present invention is the provision of an improved feeding mechanism which provides for accumulation of sheets into an orderly and precisely superimposed and justified stack.

Another object of the present invention is the provision of an improved mechanism which will release the stack without loss of justification.

Another object of the present invention is the provision of an improved feeding mechanism which assures superimposition of one sheet over the other.

Other and further objects of the invention will be obvious upon an understanding of the illustrative embodiment about to be described, or will be indicated in the appended claims and various advantages not referred to herein will occur to one skilled in the art upon employment of the invention in practice.

In order to accomplish this, the present invention provides a series of deflectors placed over a series of transport belts and a rotary indexing stop mechanism which is adapted to permit accumulation of the sheets in a stack in a stacking area located between the deflectors and the rotary indexing stop. After a predetermined number of sheets are accumulated in the stack, the stop is rotated in order to release the stack. The transport system comprises a continuously running plurality of single belts between which the sheets of paper are interposed. As each single sheet is deposited between the belts, the belts force the paper to travel forward. The leading edge of each sheet encounters the deflectors which force the paper to climb over them and, at the same time, to upwardly deflect the particular belts running within slots in the deflectors.

Once a sheet reaches the rotary stop, the trailing edge of the sheet is forced off the deflector by the transport belts, leaving room for a subsequent sheet to be deposited thereover to form a stack. When a predetermined number of sheets have been stacked in the stacking area formed by the leading edge of the stack justified precisely against the rotary stop and the trailing edge against the deflectors, the stack is ready to be released.

When a discharge signal is activited, the stop is rotated once to release the stack for forward movement as a single unitary entity.

BRIEF DESCRIPTION OF THE DRAWING

A preferred embodiment of the invention has been chosen for purposes of illustration and description and is shown in the accompanying drawings forming a part of the specification wherein.

DESCRIPTION OF THE INVENTION

Figure 1:
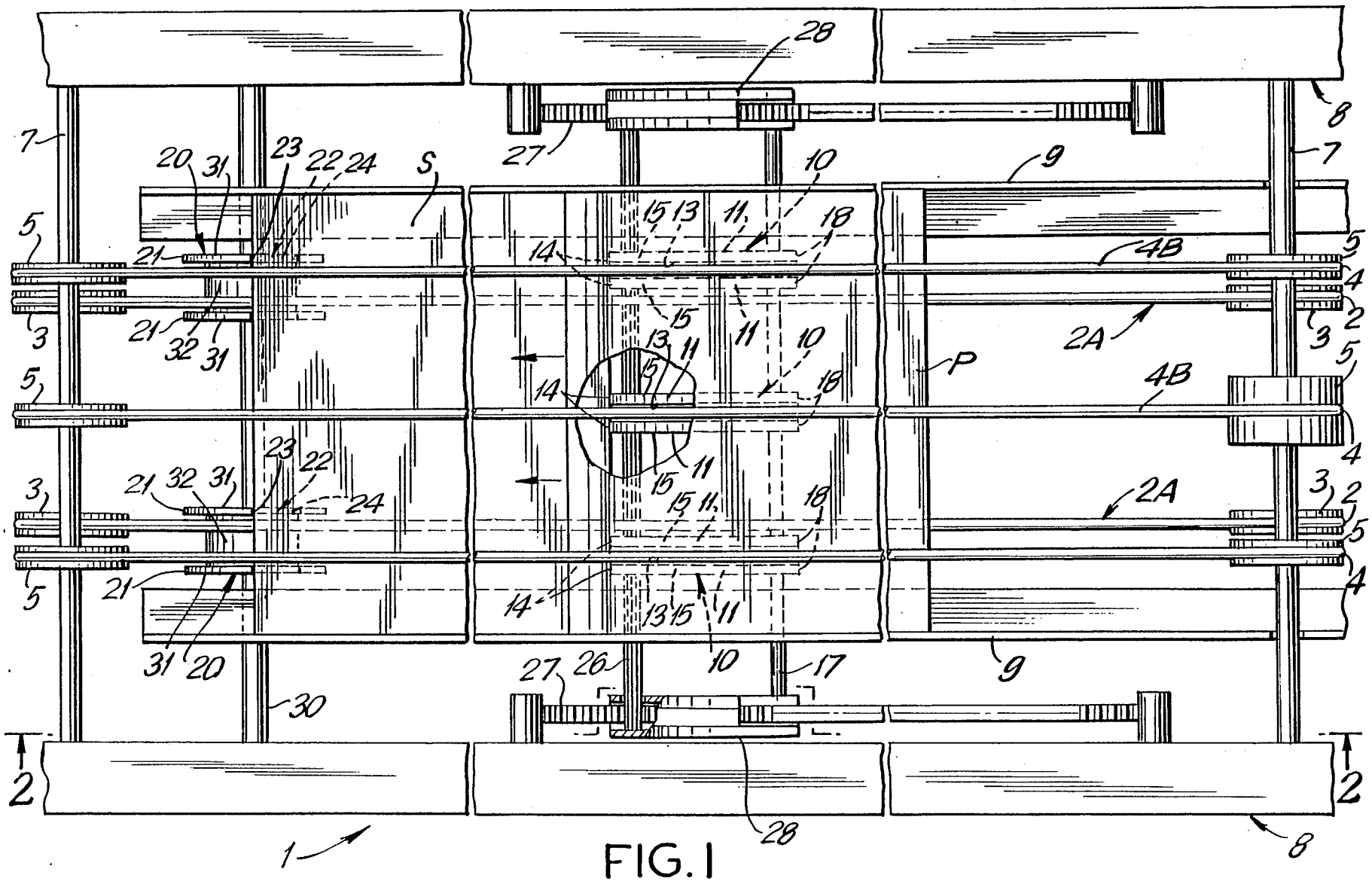
FIG. 1 is a plan view of the mechanism showing the present invention.

Referring to the drawings, the conveyor assembly 1 of the present invention comprises a plurality of lower belts 2 activated by lower pulleys 3 and a plurality of cooperating upper belts 4 activated by upper pulleys 5 which are transversely offset from, or planarly interposed between, the lower pulleys 3. The lower belts 2 consist of upper run 2A and lower run 2B and the upper belts 4 consist of upper run 4B and lower run 4A. The belts 2 and 4 are each made preferably of round cross section and medium friction polymer. Preferably, there are two spaced lower belts 2 and three spaced upper belts 3. However, it will be understood that the number of belts used may change without detracting from the invention. The offset position of the lower and upper pulleys 3 and 5, respectively, with respect to each other causes the belts 2 and 4 to be transversely offset with respect to each other in order to permit a sheet of paper P to be grasped therebetween. The lower run 4A of each upper belt 4 and the upper run 2A of each lower belt 2 are in closely adjacent planes so that each sheet P is firmly grasped therebetween and moved forward.

Each of the pulleys 3 and 4 are mounted on rotatable shafts 5 and 7, respectively, which are journalled in a frame assembly 8. Side guide rails 9 are provided between which the sheets P move to maintain them in proper orientation during their movement.

Figure 2:
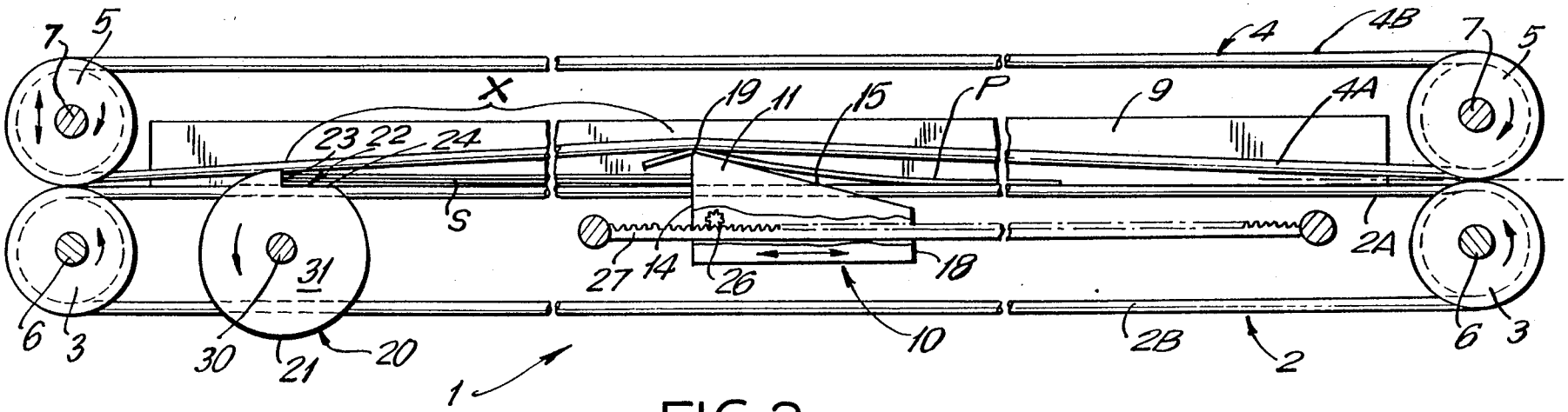
FIG. 2 is a sectional view taken along line 2—2 of FIG. 1.

A plurality of transversely spaced sheet deflectors 10 are mounted between the lower pulleys 3 by means of a support shaft 17 and a gear 26 mounted in a pair of end gear boxes 28 and moveable on rack 27 mounted on frame assembly 8. Each deflector 10 comprises a pair of thin upstanding side walls 11 connected together at 12 to form an upwardly open slot 13 to receive the lower run 4A of the upper belt 4. Each deflector 10 comprises front and rear vertical faces 14 ad 18, respectively, which are connected together by an inclined upper surface 15. The height of the front face 14 of each deflector 10 is greater than the height of the rear face 18 so that the upper leading tip 19 thereof protrudes upwardly into and through the horizontal plane of the lower runs 4A of upper belt 4, so that the said lower run 4A is normally positioned within the slot 13. A microswitch assembly 16 is also mounted within the slot 13 and is provided with a spring-pressed contact arm 29 which is normally depressed by the said lower run 4A of the upper belt 4, as shown in FIG. 2 in order to maintain the switch inactive. Preferably, there is a deflector 10 for each of the upper belts 4.

A pair of transversely spaced rotary stop wheel assemblies 20 are mounted on a shaft 30 downstream of the deflectors 10 between the lower pulleys 3. Each stop wheel 20 has a pair of thin side walls 31 connected by a core 32 so that the two side walls 31 rotate in unison in a counter-clockwise direction. The side walls 31 of each stop wheel assembly 20 has a round outer edge 21 with a notch 22 formed therein comprising a flat front face 23 and a flat bottom face 24. The flat bottom face 24 of the notch 22 is on the same plane as the upper run 2A of the lower belt 2 when the stop wheel assembly 20 is at rest as shown in FIG. 2. The distance between the flat front face 23 of the notch 22 of stop wheel assembly 20, and the flat front face 14 of each deflector 10, is substantially equal to the length of a paper P to be processed and defines a stack area X. In order to accomodate papers P of different lengths, the deflectors 10 may be adjusted lengthwise by the rack and gear assembly 27 in order to adjust the size of the stack area X.

Figure 3:
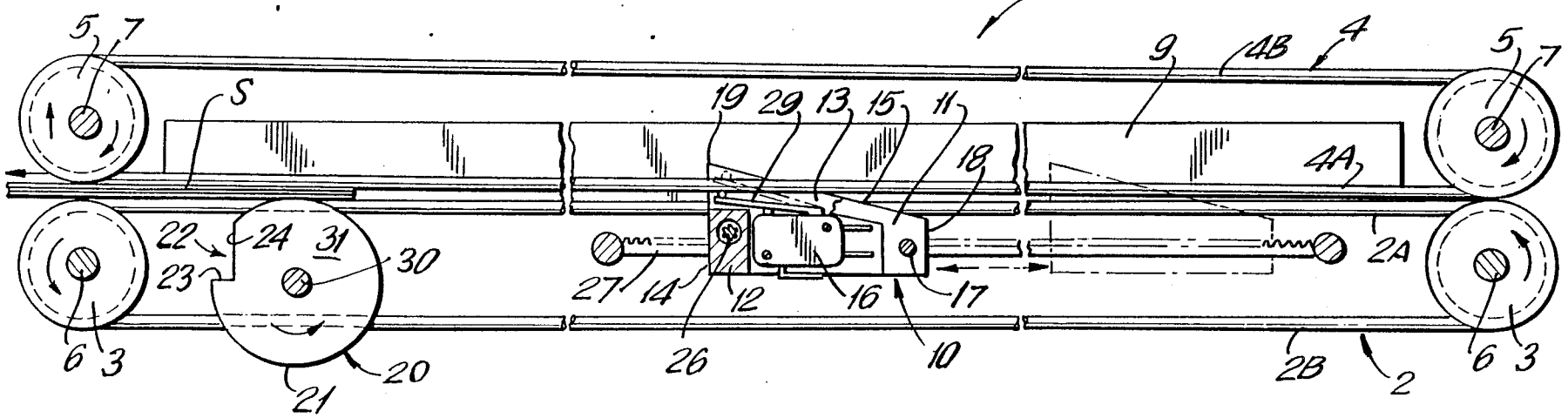
FIG. 3 is a sectional view similar to FIG. 2 showing the position of the stack after it is released.

When a sheet of paper P is moved between belts 2 and 4, the sheet P is grasped between the lower run 4A and upper run 2A of belts 4 and 2, respectively, and moved forwardly. The sheet P abuts against side guide rails 9 to maintain the proper orientation throughout its forward movement. When the sheet P strikes the inclined slope 15 of the deflectors 10, the sheet P will climb up the inclined top wall 15 and will raise the lower runs 4A of belts 4 from within the slots 13 in the deflectors 10 as shown in FIG. 2. This will enable the contact arm 29 of the microswitch 16 to move up, thereby activating the switch 16 and allowing the switch 16 to count or record the sheet P passing thereby. The paper P is then moved over the leading edge 19 of the deflectors 10 until its drops off and is positioned in the stack area X between the forward flat face 23 at the notch 22 in rotary stop wheel 20, and the front vertical faces 14 of the deflectors 10 with front portion of the paper P resting on the flat face 24 of notch 22. The process is repeated with each sheet P so that a stack S of sheets P accumulates in the stacking area X between the front vertical faces 14 and 23. When a sufficient number of sheets of paper P have accumulated in the stack S, as recorded or counted by microswitch 16, a signal is generated which permits the stop wheel 20 to rotate once in a counter-clockwise direction to release the entire stack S of sheets and move them forward, as shown in FIG. 3. It will be noted that as the sheets of paper P are stacked in stack S, the stack S is also interposed and grasped between upper run 2A and lower run 4A of belts 2 and 4, respectively, so that it is moved by these belts as soon as it is released by rotation of the wheel 20. It will also be noted that the stack S is justified endwise by vertical faces 14 and 23 and edgewise by side guide rails 9 so that when it is released, the belts 2 and 4 will grasp and move it in justified manner to the next station. The belts 2 and 4, deflectors 10 and the rotary stop wheels 20 are transversely spaced at intervals sufficient to transversely support each sheet P and the stack S throughout their forward movement with minimum transverse bending or lurching.

It will thus be seen that the present invention provides an improved feeding mechanism which requires minimum operation, training, orientation and which provides for accumulation of sheets into an orderly and precisely superimposed and justified stack and the release of the stack with one sheet superimposed over the other without loss of justification.

As many and varied modifications of the subject matter of this invention will become apparent to those skilled in the art from the detailed description given hereinabove, it will be understood that the present invention is limited only as provided in the claims appended hereto.

The embodiment of the invention in which an exclusive property or privilege is claimed are defined as follows:

1. A stop mechanism for a sheet stack-forming and feeding mechanism said sheet stack-forming mechanism comprising means for accumulating sheets in a stack between front and rear stop means, said front and rear stop means being substantially parallel to each other and perpendicular to the plane of the stack, said front stop means comprising stack stopping and stack releasing means incorporated therein, said stack releasing means comprise means for moving the front stop means away from the stack and means for moving the stack forward in a plane parallel to the plane of the stack, and means for moving the front stack means away from the front of the stack to permit the stack to move forward.

2. A stop mechanism as set forth in claim 1 wherein said front stop comprises a stop wheel having a notch therein adapted whereby forward movement of a stack is prevented and wherein said stop wheel is rotatable whereby the notch is moved away from the path of a stack.

3. A stop mechanism as set forth in claim 2 wherein said notch comprises a flat front wall and a flat bottom wall on which the stack rests.

* * * * *